US005101606A

United States Patent [19]

Meru

[11] Patent Number: 5,101,606

[45] Date of Patent: Apr. 7, 1992

[54] STRUCTURE

[76] Inventor: Horst Meru, Hohe Strasse 113, A-4020 Linz, Austria

[21] Appl. No.: 415,897

[22] Filed: Oct. 2, 1989

[30] Foreign Application Priority Data

Oct. 5, 1988 [AT] Austria ..... 2450/88

[51] Int. Cl.[5] ..... E04B 1/00

[52] U.S. Cl. ..... 52/282; 52/239

[58] Field of Search ..... 52/280–282, 52/238.1, 239

[56] References Cited

U.S. PATENT DOCUMENTS

| | | | |
|---|---|---|---|
| 2,574,074 | 11/1951 | Vogel | 52/280 X |
| 3,072,226 | 1/1963 | Harwood | 52/281 X |
| 3,251,169 | 5/1966 | Cornelissen | 52/281 X |
| 3,457,698 | 7/1969 | Albers | 52/282 X |
| 3,465,487 | 9/1969 | Fatosme et al. | 52/281 X |
| 3,885,367 | 5/1975 | Thunberg | 52/282 X |
| 4,843,788 | 7/1989 | Gavin et al. | 52/238.1 X |

FOREIGN PATENT DOCUMENTS

| | | | |
|---|---|---|---|
| 263383 | 6/1963 | Australia | 52/281 |
| 326876 | 11/1969 | Austria . | |
| 316815 | 7/1971 | Austria . | |
| 365265 | 8/1977 | Austria . | |
| 364939 | 5/1978 | Austria . | |
| 632306 | 12/1961 | Canada | 52/280 |
| 89540 | 11/1960 | Denmark | 52/281 |
| 0284775 | of 0000 | European Pat. Off. . | |
| 0118411 | 6/1984 | European Pat. Off. . | |
| 2008561 | 9/1970 | Fed. Rep. of Germany | 52/280 |
| 2931026 | 7/1979 | Fed. Rep. of Germany . | |
| 3039388 | 10/1980 | Fed. Rep. of Germany . | |
| 3139248 | 10/1981 | Fed. Rep. of Germany . | |
| 3709541 | 3/1987 | Fed. Rep. of Germany . | |
| 976022 | 11/1964 | United Kingdom | 52/281 |
| 2052003 | 9/1979 | United Kingdom . | |

*Primary Examiner*—David A. Scherbel
*Assistant Examiner*—Lan Mai
*Attorney, Agent, or Firm*—Collard, Roe & Galgano

[57] ABSTRACT

A structure comprises uprights and connecting beams as well as wall panels and vertically spaced apart horizontal partitions inserted between said uprights and beams. To permit the structure to be assembled and disassembled without a need for tools, the wall panels are provided with vertical edge flanges, which extend into grooves formed in the uprights, the uprights are interlocked with the connecting beams, and the wall panels and horizontal partitions are held between upper and lower connecting beams against a vertical displacement.

20 Claims, 5 Drawing Sheets

FIG.6
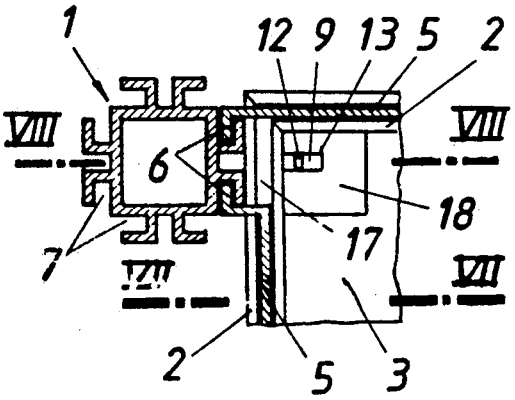
FIG.7
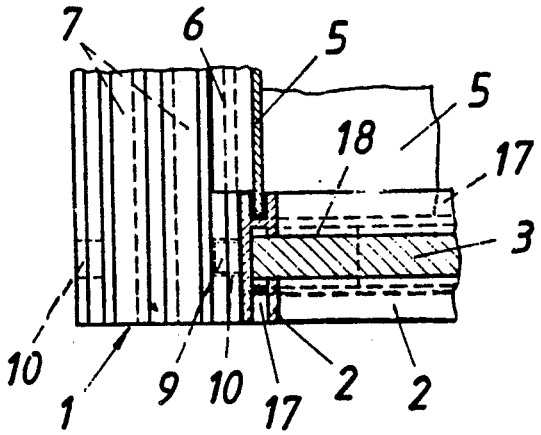
FIG.8
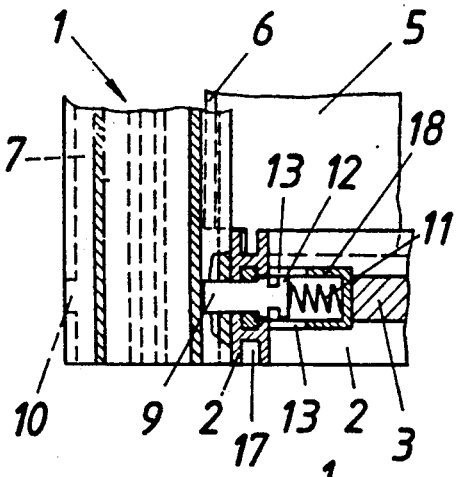
FIG.9
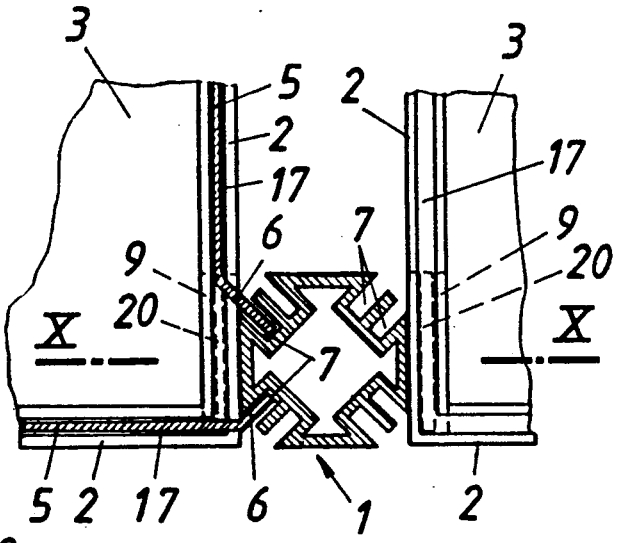
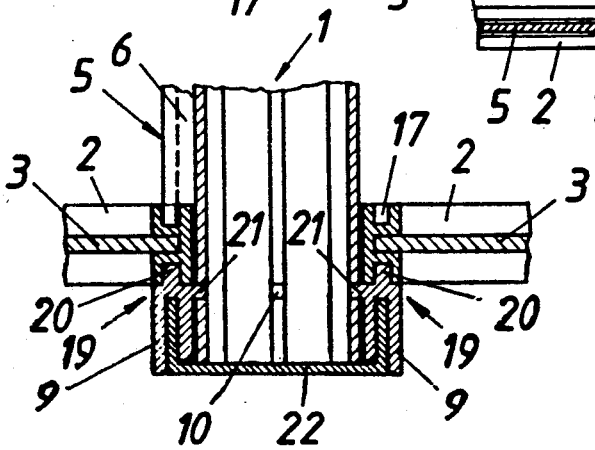
FIG.10

STRUCTURE

BACKGROUND OF THE INVENTION

1. Field of the Invention

This invention relates to a structure comprising uprights, connecting beams between the uprights, and wall panels, which have been inserted between the uprights and at least one floor and a ceiling.

2. Description of the Prior Art

In known building structures of that kind the uprights and the connecting beams disposed between the uprights have been assembled to form a load-carrying skeleton, which for an insertion of floors, ceilings and walls defines fields, which are defined by the connecting beams and by the connecting beams and the uprights. To permit such structures to be disassembled in a simple manner and to be reassembled in a simple manner optionally with a different division of the included space, screw connections are provided between the uprights and the connecting beams and between said carrying members of the skeleton and the floors, ceilings and walls. But in spite of the provision of such screw connections the assembling work is relatively expensive. Besides, the several components of the structure must be provided with holes for receiving the connecting screws so that the manufacture of such components will be more expensive and their strength adjacent to such holes will be decreased. Besides, it is often required that the screw connections should be concealed from sight by covering means, which also add to the structural expenditure.

In order to provide structures which have no screw connections and can be assembled and disassembled in a simple manner it is known (Austrian Patent Specification 364,939) to provide walls which are disposed between a floor frame and a ceiling frame and are connected to each other and to the floor frame and the ceiling frame by node members, which are slidably fitted on lugs protruding from the walls. Whereas the provision of such node members will eliminate the need for screw connections and will permit the structure to be assembled and disassembled without a need for tools, the resulting structure has only a low load-carrying capacity because any load which is applied can be taken up only via the wall panels.

SUMMARY OF THE INVENTION

For this reason it is an object of the invention to eliminate said disadvantages and to provide a structure which is of the kind described first hereinbefore and which is so improved with simple means that the structure can be assembled and disassembled without a need for tools and the structure nevertheless has a high load-carrying capacity.

It is another object to provide such a building structure which permits a substantially unrestricted division of the included space and which can be used for various purposes.

Said objects are accomplished in accordance with the invention in that the wall panels are provided at their vertical outer edges with angled edge flanges, which extend into mating grooves, which are formed in the uprights and extend throughout the length of each upright, the uprights are adapted to be interlocked with the connecting beams by means of locking members extending into locking recesses of the uprights, and each wall panel is retained between upper and lower connecting beams against a vertical displacement.

The edge flanges provided on the wall panels and extending into mating grooves of the uprights establish positive joints between the wall panels and the uprights. Said joints resist tension in the horizontal direction of the wall panels so that those uprights which are provided at opposite ends of a wall panel are connected by a tension-resisting connection which is constituted by said wall panel and are connected by a compression-resisting connection which is constituted by the interposed connecting beams. Because the connecting beams which are interlocked with the uprights ensure a displacement-preventing retention of the wall panels disposed between upper and lower connecting beams, strong connections are provided between said individual components and can be separated only in that the connecting beams are unlocked from the uprights. Said connecting beams and uprights are interlocked by means of locking members, which extend into locking recesses of the uprights and which can be dimensioned so that said locking members can transmit even strong forces between the uprights and the connecting beams. As a result, the components which have been assembled constitute a composite structure which can desirably take up the loads which may be applied. Nevertheless the freedom of design will not be restricted because the composite action does not depend on the shape of the components of the structure but on the manner in which said components are joined. For this reason such structures may be used in various fields, e.g., in building structures, in furniture and in containers.

Particularly desirable structural relationships can be achieved in that the uprights are provided in each joint-forming side face with grooves for connection to two wall panels. In that case, two parallel wall panels may be provided between two uprights and may be used, e.g., to separate two juxtaposed rooms so that each room is defined by a separate wall panel also adjacent to another room. Such a provision of double walls will not only increase the load-carrying capacity of the entire structure but will also permit an installation of pipes or lines between such parallel walls or a provision of insulation between the parallel walls. If two grooves are provided in one joint-forming side face and the edge flanges are properly angled it will be possible to join two wall panels which extend at an angle to each other to one side of an upright.

The floor and the ceiling may be inserted into respective frames, which are constituted by the connecting beams disposed between individual uprights and may stiffen such frames at their corners. In order to prevent a lifting of the floor or of the ceiling from such frames, each of the floor and ceiling members is clamped between the connecting beams and the wall panels or between wall panels disposed one over the other. Alternatively, the connecting beams need not constitute separate members but may be integral with the floor or ceiling and in that case the ceiling and the floor will be held in position by the interlock between the connecting beams and the uprights.

If the edge flanges of each wall panel are inclined toward each other or are angled in themselves toward each other, said wall panels will be held in position in the grooves of the uprights also against a displacement at right angles to the wall panel. But the edge flanges of such wall panels can be inserted into the grooves only in the longitudinal direction of the uprights.

In order to permit a slidable insertion of the edge flanges into the grooves of the uprights also at right angles to the wall panel which is concerned, the edge flanges of the wall panels may protrude from the wall panel at right angles thereto. In that case the wall panel must additionally be held against a transverse displacement. This can be accomplished in that the floor and the ceiling or the connecting beams constitute stops, which are engaged by the top and bottom longitudinal edge portions of the wall panel on that side of the wall panel which is opposite to the grooves of the adjacent uprights. Whereas the wall panels must then be displaced in the longitudinal direction of the uprights to extend behind such stops, the stops may have a relatively small height so that the wall panels can be inserted after they have been vertically displaced to an extent corresponding to the height of the stops.

Because the wall panels may be inserted into corresponding grooves of the uprights from the inside or from the outside of a room, a stop which is engaged by the longitudinal edge portion of a wall panel on the outside thereof cannot retain such wall panel against a transverse displacement if the wall panel has been inserted between the uprights from the inside. To ensure nevertheless that the wall panels will be held in position it is possible to provide such wall panel with a counterstop, which is engaged by the outside surface of a stop provided on the floor, the ceiling or the connecting beam.

Alternatively, wall panels which have been inserted into the grooves of the uprights from the inside or from the outside in a direction which is transverse to the wall surface can be held against a transverse displacement in that the top and bottom edge portions of the wall panels are inserted into guiding grooves formed in the floor, in the ceiling and/or in the connecting beams so that additional joints are provided between the wall panels, on the one hand, and the floor and the ceiling, on the other hand.

The tension-resisting connection provided between uprights disposed on opposite sides of a wall panel eliminates the need for providing a tension-resisting joint between the uprights and the connecting beams. Nevertheless it may be desirable to provide an additional tension-resisting joint between the uprights and the connecting beams in that the connecting beams are provided with guiding lugs, which extend into the grooves of the uprights and act like the edge flanges of the wall panels.

To permit the connecting beams to be interlocked with the uprights in a simple manner by means of the locking members extending into the locking recesses of the uprights, the locking members may be slidably mounted in the connecting beams so that the displacement-preventing joint can be provided in that the locking members are extended from the connecting beams into the locking recesses of the uprights. If the locking members are biased in the locking sense by a spring in that case, such spring will ensure that the locking members will be moved to their locking position. On the other hand, it will then be necessary to overcome the force of that biasing spring if the interlock is to be eliminated in that the locking members are pulled out of the locking recesses of the uprights.

The locking members for connecting the connecting beams and the uprights need not permanently be mounted in the connecting beams but may be constituted by initially loose elements, which can slidably be inserted into the locking recesses which are formed in the uprights and in the connecting beams and together constitute a common locking opening. Alternatively, an effective interlock between the uprights and the connecting beams may be provided in that the locking members which extend into corresponding locking recesses of the uprights are coupled to the connecting beams by a lug coupling, which is adapted to be disengaged by a movement of the connecting beams in the longitudinal direction of the uprights. Whereas such lug coupling will permit a detaching of the connecting beams from the locking member in one direction, such a detaching will be prevented by the wall panel which is subsequently inserted.

Various means may be provided to lock the locking members against an unintended extraction from the locking recesses of the uprights. This can be accomplished in a simple and effective manner if those locking members which engage an upright adjacent to a floor or a ceiling are coupled at least in groups by means of a clamp which will prevent a movement of the locking members in mutually opposite directions relative to each other.

BRIEF DESCRIPTION OF THE DRAWING

FIG. 6 is a fragmentary horizontal sectional view showing another modified structure.

FIG. 7 is a sectional view taken on line VII—VII in FIG. 6.

FIG. 8 is a sectional view taken on line VIII—VIII in FIG. 6.

FIG. 9 is a fragmentary horizontal sectional view showing a further modified structure.

FIG. 10 is a sectional view taken on line X—X in FIG. 9.

DETAILED DESCRIPTION OF THE PREFERRED EMBODIMENTS

Figure 1:
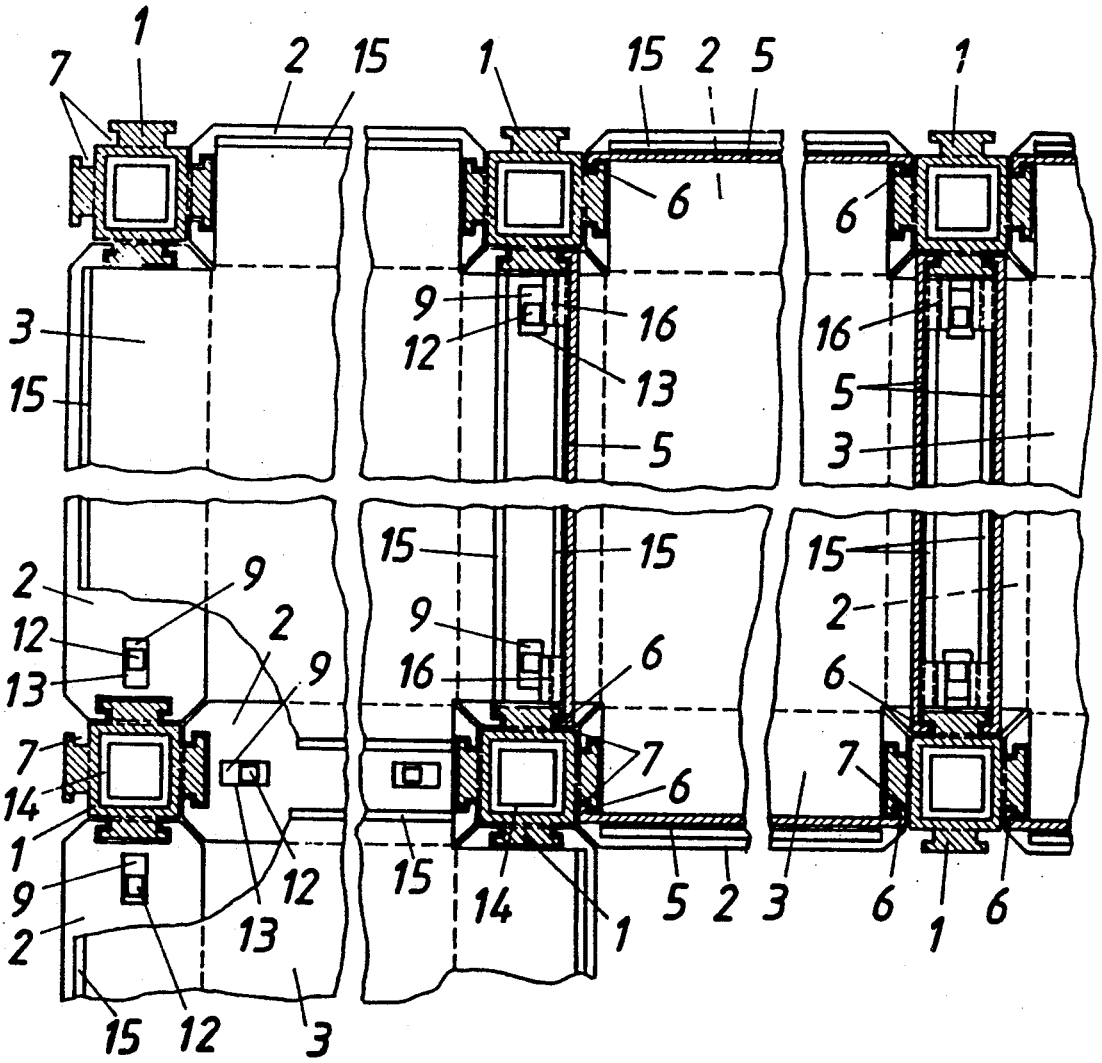
FIG. 1 is a fragmentary sectional view showing a structure which embodies the invention.

Illustrative embodiments of the invention will now be described more in detail with reference to the drawing.

In the illustrative embodiment shown in FIGS. 1 to 4 the structure comprises uprights 1, connecting beams 2 between the uprights 1, floors 3, which rest on the connecting beams 2, ceilings 4, and wall panels 5, which are installed between the floors 3 and the ceilings 4. Said parts have been assembled to form a composite structure without a need for tools and without special fasteners. This is enabled in that the wall panels 5 are provided at their vertical outer edges with angled edge flanges 6 and the uprights 1 are formed throughout their length with continuous grooves 7, which receive the edge flanges 6. The connecting beams 2 are optionally provided with guiding lugs 8, which also extend into the grooves 7. The connecting beams 2 are provided at their ends with locking members 9, which extend into locking recesses 10 of the uprights 1. As is particularly apparent from FIGS. 3 and 4 the locking members 9 are mounted in the connecting beams 2 to be displaceable along the latter and are biased in the locking sense by springs 11, which hold the locking members 9 in their locking position and prevent an undesired unlocking. Owing to that spring bias the locking members 9 must be retracted against the force of the spring 11 to the unlocking position shown in FIG. 3 when the guiding lugs 8 of the connecting beams 2 are to be inserted into the grooves 7. To that end the locking members 9 are provided with coupling elements 12, which are accessible for actuation through apertures 13 formed in the connecting beams 2.

Each upright 1 preferably consists of a section element, which defines the grooves 7. Each upright 1 is desirably provided in each joint-forming side face with two grooves 7 for connection to two wall panels 5. As a result, a wall panel 5 can selectively be inserted into one of the grooves 7 or the other or a double wall may be constituted by a pair of parallel wall panels so that the freedom for the design of the structure is increased further. Because each upright 1 consists of a section element, an additional operation is usually required to form the locking recesses 10. For this reason it may be preferably to form the locking recesses 10 in separate end pieces 14, which are subsequently joined to the upright section when it has been cut to length. This is particularly apparent from FIG. 4.

Figure 2:
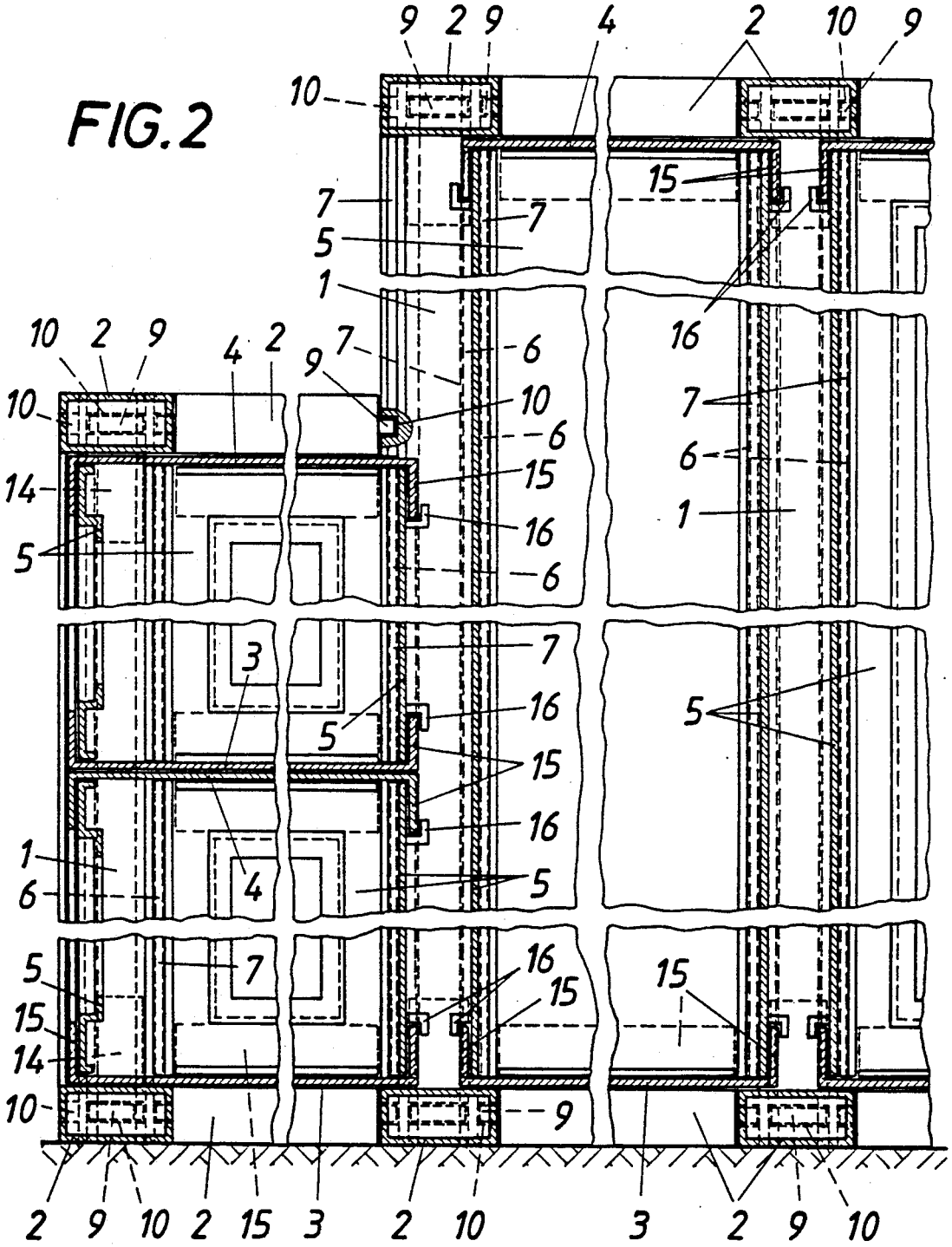
FIG. 2 is a vertical sectional view showing that structure.

To assemble the structure shown in FIGS. 1 and 2 the lowermost connecting beams 2 are first locked to the uprights 1 by means of the locking members 9. To that end the uprights 1 may be mounted on the end pieces 14 when the latter have been connected to the connecting beams 2. When a bottom structure has thus been formed by the lowermost connecting beams 2 and the uprights 1, the floors 3 are placed on said bottom structure before the wall panels 5 are inserted into the grooves 7 of the uprights 1. The wall panels may be of widely varying designs and may be provided with door and/or window openings. Because the edge flanges 6 protrude from the wall panels 5 at right angles thereto, the wall panels need not be inserted into the grooves along the uprights but may be inserted transversely to the wall surface. In that case the wall panels must be retained against a subsequent transverse displacement. To that end each floor 3 is provided with an edge flange 15, which rises between the uprights 1 and constitutes a stop, which is disposed on the outside of and engaged by the bottom longitudinal edge portion of the adjacent wall panel 5. When the wall panel has been inserted between the uprights from the outside, the stop 15 will be disposed on the outside, i.e. on that side of the wall panel which is remote from the grooves 7, the wall panel which has been inserted into the grooves 7 by a transverse displacement will move to a position in front of the stop 15 after a downward movement and will be retained by said stop against emerging from the grooves.

Such a retention can be provided only for wall panels which have been inserted from the outside and cannot be provided for wall panels which have been inserted from the inside because the stop 15 engaging the wall panel on the outside obviously can prevent only a displacement of the wall to the outside. For this reason the wall panels which have been inserted from the inside carry counterstops 16, which extend on the outside of the stop 15 to prevent a transverse movement of such wall panels 5.

When the wall panels 5 have been inserted between the uprights 1, the ceilings 4 are placed on the wall panels 5. The ceilings 4 are provided with depending edge flanges, which correspond to the upstanding edge flanges of the floors 3 and also constitute stops 15, which extend on the outside of and are engaged by the top longitudinal edge portions of the wall panels 5. It is apparent that said ceilings are similar to the floors and the floors and ceilings may be constituted by the same components, provided that the ceilings and floors have at least one axis of symmetry, as will always be the case in view of the desired combination of the components of the structure. In that case said components can selectively be used as floors or as ceilings. To ensure that wall panels 5 which have been inserted from the inside will be held in position, they must be provided also adjacent to each ceiling with counterstops 16, which extend on the outside of and are engaged by the stops 15, which are provided on the ceilings and extend on the outside of and are engaged by the wall panels 5.

Another floor 3 may then be placed on the ceiling 4 so that an additional room-forming module can be erected over the room-forming module which is constituted by the previously installed floor, wall panels and ceiling. This is illustrated on the left in FIG. 2. On the right side of FIG. 2 it is shown that the wall panels 5 rise above the uprights 1 and the ceiling 4 is covered at its edges by upper connecting beams 2, which like the lower connecting beams 2 are locked to the uprights 1 by locking members 9, which extend into locking recesses 10. As a result, all components which are disposed between the top and bottom connecting beams 2 and have been inserted between the uprights 1 are held against a vertical displacement and a composite structure having a high strength is obtained.

If two or more room-forming modules are formed one over the other, said room-forming modules may be held between top and bottom connecting beams against a vertical displacement. On the other hand, connecting beams 2 may be provided between individual room-forming modules which are arranged one over the other. But in that case the confronting floors and ceilings between the room-forming modules cannot be constituted by a common component unless the connecting beams are integral with such component and constitute, e.g., a frame for a floor and/or ceiling panel, as is particularly apparent from FIGS. 7 and 10.

Figure 5:
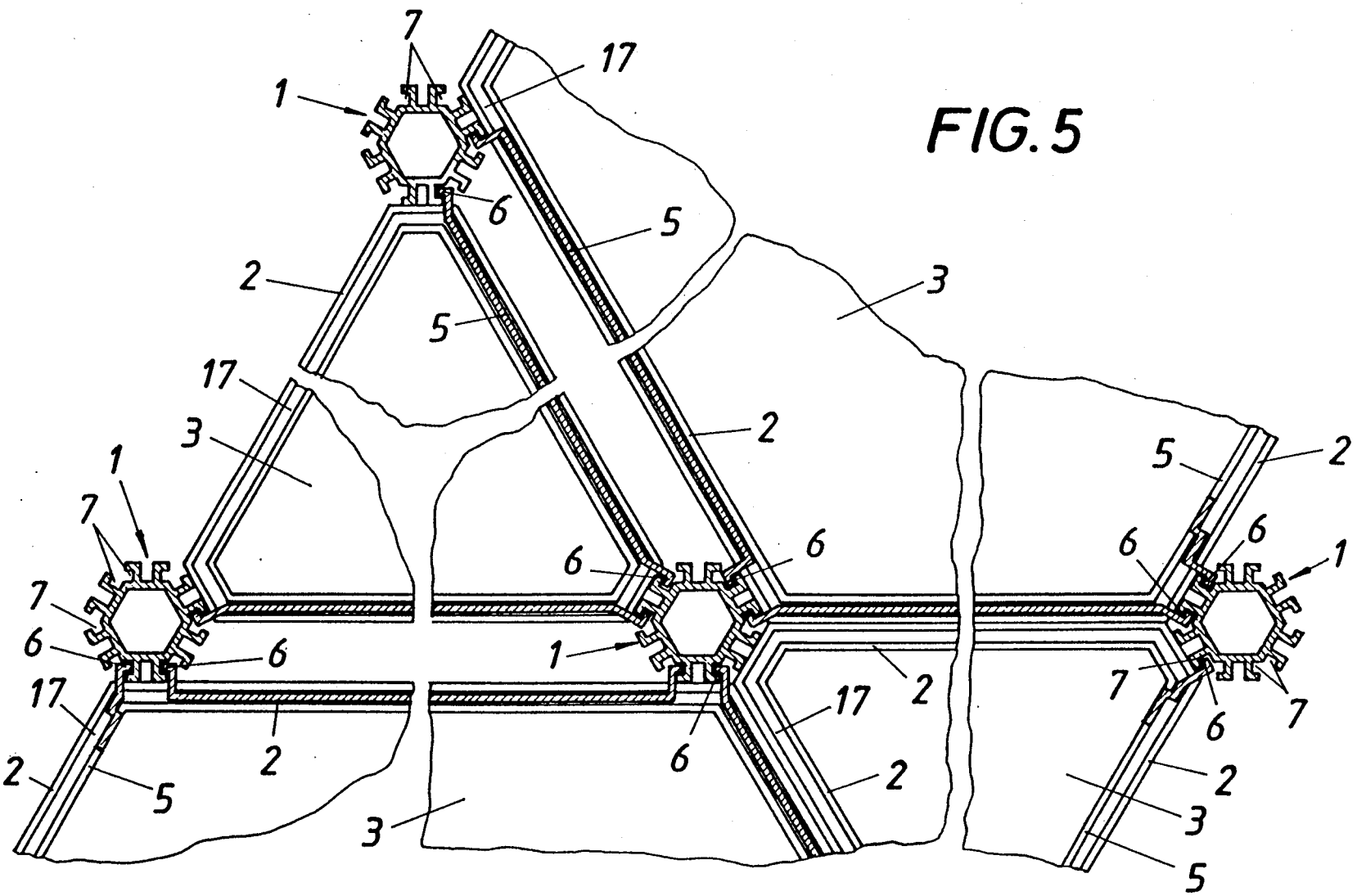
FIG. 5 is a fragmentary horizontal sectional view showing a modified structure.

The skeleton which is constituted by the uprights 1 and the connecting beams 2 between the uprights 1 will often be right-angled but may alternatively include different angles between its components. In the structure which is shown in FIG. 5 each upright 1 has six jointforming side faces so that room-forming modules can be constituted which have in a plan view the configuration of an equilateral triangle or hexagon. A further difference from the structure shown in FIGS. 1 and 2 resides in that the floors 3 and the ceilings 4 are formed in their edge portions with guiding grooves 17 for receiving the longitudinal edge portions of the wall panels 5 so that the latter will reliably be held in said guiding grooves 17 against a transverse displacement. Besides, those portions of the edge flanges 7 of the wall panels 5 which extend into the grooves 6 of the uprights 1 are angled toward each other in themselves to prevent a transverse displacement of the wall panels. The general design and the assembling of the components of the structure will be the same as in the embodiment described first.

Figure 3:
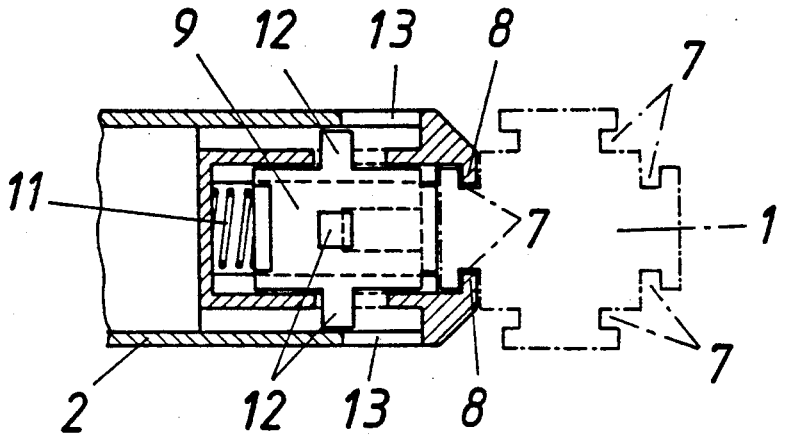
FIG. 3 is a horizontal sectional view showing the end portion of a connecting beam on a larger scale.
Figure 4:
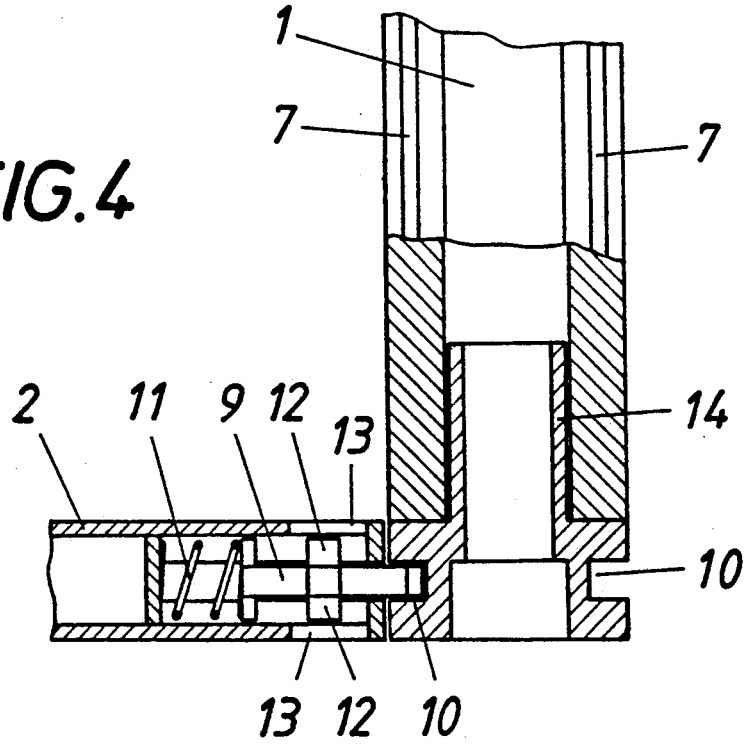
FIG. 4 is a vertical sectional view illustrating how a connecting beam as shown in FIG. 3 is interlocked with an upright.

In the illustrative embodiment shown in FIGS. 6 to 8 the connecting beams 2 constitute a closed frame, which is constituted by section elements and in which a horizontal partition has been inserted to constitute a floor 3 and/or a ceiling 4. That component may selectively be used as a floor or a ceiling and need not even be turned upside down because it is symmetrical with respect to a horizontal center plane. The frame consisting of section elements is formed with two guiding grooves 17, which are open upwardly and downwardly, respectively, and receive the adjacent longitudinal edge portions of wall panels. To lock the section element frame to the uprights 1, locking member housings 18 are provided in the corner portions of the frame and each of said housings contains a slidably mounted locking member 9, which as in the embodiment shown in FIGS. 3 and 4 is biased in the locking sense by a spring 11 so that the locking member is displaced into a locking recess 10 of the adjacent upright 1.

In the illustrative embodiment shown in FIGS. 9 and 10, the structure also comprises connecting beams 2 which constitute respective units with a floor 3 and/or a ceiling 4. A difference from the design shown in FIGS. 6 to 8 resides in that the locking members 9 are not movably mounted in the connecting beams 2 but are coupled to the latter by a lug coupling 19. For that purpose each locking member 9 is provided with a protruding lug 20, which extends into the guiding groove 17. To lock the connecting beams 2 to the uprights 1 the locking noses 21 of the locking members 9 are slidably inserted into the locking recesses 10 of the uprights 1 until the locking noses 21 engage the uprights 1. The connecting beams are then fitted on the protruding lugs 20 to engage a stop, which is constituted by the locking members 9. That stop will effectively prevent a pulling of the connecting beams 2 from the coupling lugs 20 beyond the ends of the uprights 1. A displacement in the opposite sense, i.e., in the sense of a separation of the lug coupling 19, will be prevented by the wall panels 5 when they have subsequently been inserted into the guiding grooves 17. To retain the locking members 9 in their locking position, it is preferable to provide a clamp 22, by which locking members disposed on opposite sides of an upright are interconnected.

It is apparent from FIG. 9 that the edge flanges 6 of the wall panels 5 may be inclined toward each other from the plane of the wall, provided that the grooves 7 in the uprights are correspondingly inclined. A particularly desirable design will be obtained if the edge flanges 6 extend along the bisector of the angle included by two wall panels at a corner.

It will be understood that the invention is not restricted to the embodiments illustrated by way of example. For instance, different components used in different embodiments may be combined in any suitable manner and different designs may be adopted, particularly as regards the means by which the connecting beams are interlocked with the uprights because it is merely essential that the connecting beams interlock with the uprights and that interlock may be established in various ways.

I claim:

1. In a structure comprising a plurality of horizontally spaced apart uprights, each of which has at least two joint-forming side faces, a plurality of horizontal connecting beams, which constitute at least two vertically spaced apart horizontal annular sets of beams and each of which connects two adjacent ones of said uprights, at least two vertically spaced apart horizontal partitions extending between said uprights, and a plurality of vertical wall panels, each of which has vertical outer edges and extends between two of said uprights and two of said horizontal partitions and is joined to each of said uprights at one of said joint-forming side faces thereof, the improvement residing in that each of said uprights is formed in each of said joint-forming side faces thereof with at least one undercut vertical groove extending throughout the length of said upright, each of said wall panels is provided at each of said vertical outer edges with an angled edge flange fitting into one of said undercut grooves, said uprights are formed adjacent to each of said sets of beams with locking recesses, locking members are provided, which extend into said locking recesses and are arranged to lock said connecting beams to said uprights, and said connecting beams of said vertically spaced apart sets of beams are arranged to retain said wall panels against a vertical displacement.

2. The improvement set forth in claim 1 as applied to a structure in which said horizontal partitions constitute at least one floor and at least one ceiling.

3. The improvement set forth in claim 1, wherein each of said uprights is provided in each of said joint-forming side faces with two of said vertical grooves.

4. The improvement set forth in claim 3, wherein said wall panels comprise pairs of wall panels which constitute double walls and said angled edge flanges of the wall panels of each of said pairs extend into respective ones of said two undercut vertical grooves in each of said side faces of said adjacent uprights.

5. The improvement set forth in claim 1, wherein at least one of said horizontal partitions is retained between said connecting beams of one of said sets of beams and said wall panels.

6. The improvement set forth in claim 1, wherein said connecting beams constitute at least three vertically spaced apart horizontal annular sets of beams, said wall panels constitute at least two vertically spaced apart annular sets of wall panels, and at least one of said horizontal partitions is retained between the wall panels of said two sets of wall panels.

7. The improvement set forth in claim 1, wherein said connecting beams are integral with said horizontal partitions.

8. The improvement set forth in claim 1, wherein said angled edge flanges of each of said wall panels are inclined toward each other.

9. The improvement set forth in claim 1, wherein said edge flanges of each of said wall panels are angled in themselves toward each other.

10. The improvement set forth in claim 1, wherein said edge flanges of each of said wall panels protrude therefrom at right angles thereto.

11. The improvement set forth in claim 10, wherein each of said wall panels has top and bottom horizontal edge portions and has a first side facing said grooves and a second side which is opposite to said first side, and each of said horizontal partitions is provided adjacent to each of said wall panels with a stop, which extends on said second side of said wall panel and is engaged by one of said horizontal edge portions.

12. The improvement set forth in claim 11, wherein each of said wall panels is provided on said second side with a counterstop, which overlaps said stop on the outside thereof and is engaged by said stop.

13. The improvement set forth in claim 10, wherein each of said wall panels has top and bottom horizontal edge portions and has a first side facing said grooves and a second side which is opposite to said first side, and each of said connecting beams is provided adjacent to each of said wall panels with a stop, which extends on said second side of said wall panel and is engaged by one of said horizontal edge portions.

14. The improvement set forth in claim 13, wherein each of said wall panels is provided on said second side with a counterstop, which overlaps said stop on the outside thereof and is engaged by said stop.

15. The improvement set forth in claim 1, wherein each of said horizontal partitions is formed with guiding grooves, which are open toward the other of said horizontal partitions and each of said wall panels has top and bottom horizontal edge portions extending into said guiding grooves.

16. The improvement set forth in claim 1, wherein said connecting beams are provided with guiding lugs extending into said grooves in said uprights.

17. The improvement set forth in claim 1, wherein said locking members are slidably mounted in said connecting beams.

18. The improvement set forth in claim 17, wherein said connecting beams are provided with springs urging said locking members into said locking recesses.

19. The improvement set forth in claim 1, wherein said locking members are releasably coupled to said connecting beams by a lug coupling, which is disengageable by a vertical movement of said connecting beam.

20. The improvement set forth in claim 1, wherein each of said uprights is provided with a plurality of said locking recesses adjacent to each of said horizontal partitions and a plurality of said locking members extend into respective ones of said locking recesses of each of said pluralities thereof, and at least two of said locking members of each of said pluralities thereof are releasably coupled by a clamp.

* * * * *